US006021913A

United States Patent [19]

McGrath

[11] Patent Number: 6,021,913

[45] Date of Patent: Feb. 8, 2000

[54] TRAY SYSTEM FOR BEVERAGE CANS AND A BEVERAGE CAN TRAY

[76] Inventor: Patrick James McGrath, 5996 Bent Pine Dr., Apt. #3411, Orlando, Fla. 32822

[21] Appl. No.: 08/767,826

[22] Filed: Dec. 17, 1996

[51] Int. Cl.[7] ..... B65D 75/00

[52] U.S. Cl. ..... 220/513; 220/519; 220/669; 220/516; 206/427; 206/503

[58] Field of Search ..... 220/513, 519, 220/516, 517, 669; 206/427, 503

[56] References Cited

U.S. PATENT DOCUMENTS

| | | | |
|---|---|---|---|
| D. 98,200 | 1/1936 | Worthington | 220/516 |
| D. 327,970 | 7/1992 | Watanabe et al. | D34/40 |
| 2,619,251 | 11/1952 | Schmidt | 220/513 |
| 3,092,284 | 6/1963 | Stout | 220/516 |
| 3,106,308 | 10/1963 | Kazimier | 220/21 |
| 3,151,762 | 10/1964 | Vidal | 220/21 |
| 3,812,996 | 5/1974 | Bunnell | 220/21 |
| 3,919,379 | 11/1975 | Smarook | 220/516 |
| 4,722,440 | 2/1988 | Johnson | 206/501 |
| 4,899,874 | 2/1990 | Apps et al. | 206/201 |
| 4,932,532 | 6/1990 | Apps et al. | 206/503 |
| 5,009,053 | 4/1991 | Langenbeck et al. | 53/58 |
| 5,038,961 | 8/1991 | Watanabe et al. | 220/516 |
| 5,105,948 | 4/1992 | Morris et al. | 519/519 |
| 5,115,937 | 5/1992 | Chausse et al. | 220/519 |
| 5,184,748 | 2/1993 | Apps | 220/516 |
| 5,213,211 | 5/1993 | Umiker | 206/821 |
| 5,230,601 | 7/1993 | Apps et al. | 414/786 |
| 5,285,899 | 2/1994 | Apps et al. | 206/503 |
| 5,335,814 | 8/1994 | Hepp | 220/519 |
| 5,377,862 | 1/1995 | Oakes et al. | 220/519 |
| 5,495,945 | 3/1996 | Apps et al. | 220/516 |
| 5,529,176 | 6/1996 | Apps et al. | 206/201 |
| 5,575,390 | 11/1996 | Apps et al. | 220/519 |
| 5,785,170 | 7/1998 | Hammett | 220/516 |
| 5,826,742 | 10/1998 | Timpert | 220/519 |

FOREIGN PATENT DOCUMENTS

| | | | |
|---|---|---|---|
| 965056 | 3/1975 | Canada | 217/160 |

*Primary Examiner*—Joseph M. Moy

*Attorney, Agent, or Firm*—Robert L. Wolter; David G. Maire; Holland & Knight, LLP

[57] ABSTRACT

The tray has an outer rectangular panel that has two opposing end walls and two side walls. A plurality of rows of the cells extend from one end panel to the other, intermediate the side panels. Gaps are formed in the outer panel adjacent some of the cells to expose the can labels or UPC codes. The outer panel has a flat surface so advertising may be placed on the outer panel.

31 Claims, 5 Drawing Sheets

TRAY SYSTEM FOR BEVERAGE CANS AND A BEVERAGE CAN TRAY

FIELD OF THE INVENTION

This invention relates to trays used for storage, shipping and display of containers such as beverage cans.

BACKGROUND OF THE INVENTION

Beverage distributors and retailers often use plastic reusable trays to ship twelve and twenty-four ounce aluminum beverage cans. Can-filled trays are usually stacked on top of each other with the bottom of an upper tray engaging the top of the beverage cans. The entire stack is banded and wrapped on a pallet.

When the beverage cans are shipped to a retailer, a retailer may remove the cans from their trays for display. The empty trays are stacked and set aside for the distributor. The distributor bands the stack and/or wraps it in an air tight plastic wrap for storage and transportation. This is done in order to secure the tray stack. Many of the trays that are presently used form unstable pillars that tend to sway after a number of trays are stacked.

Often times cans are maintained in the trays for display to consumers at retail stores. Many of the trays used today cover the cans prohibiting exposure of the labels. In addition, the trays are not adapted for print advertising on its sides.

SUMMARY OF THE INVENTION

An objective of the foregoing invention is to provide a beverage can tray system and a tray for beverage cans that includes a stable tray-stack of empty trays or of can-filled trays.

Another objective is to provide such a tray for twenty-four or twelve beverage cans. Yet another objective is provide a light weight tray with a rigid structure.

Still another goal is to provide a tray that has a low profile to securely stack a greater number of empty trays.

Another objective is to provide the trays of the tray system with an outside panel for advertising and/or displaying product information.

These and other objectives are achieved by a tray system and tray for cans having a plurality of cells mounted within an outer panel. The tray has an outer rectangular panel that has two opposing end walls and two side walls. A plurality of rows of the cells extend from one end panel to the other, intermediate the side panels.

Gaps are formed in the outer panel adjacent some of the cells to expose the can labels or UPC codes. The outer panel has a flat surface so advertising may be placed on the outer panel.

Each cell has a vertically disposed circular wall and a bottom section for holding a single can. The bottom section of each cell depends below a plane defined by a bottom edge of the outer panel. A protuberance depends from the bottom section of each cell and engages the top rim of a can when can-filled trays are stacked.

Each cell in a single tray has a centerline distance between itself and an adjacent cell within that tray. When trays are aligned side-by-side or end-to-end, there exists a second centerline distance between cells adjacent an end wall or side wall of a first tray and cells along an end wall or side wall of a second tray. The second centerline distance between two trays is approximately equal to the first centerline distance within a first tray. This orientation of the cells creates an interlocking tray system that provides a stable stack of empty and can-filled trays.

DETAILED DESCRIPTION OF THE DRAWINGS

Figure 1:
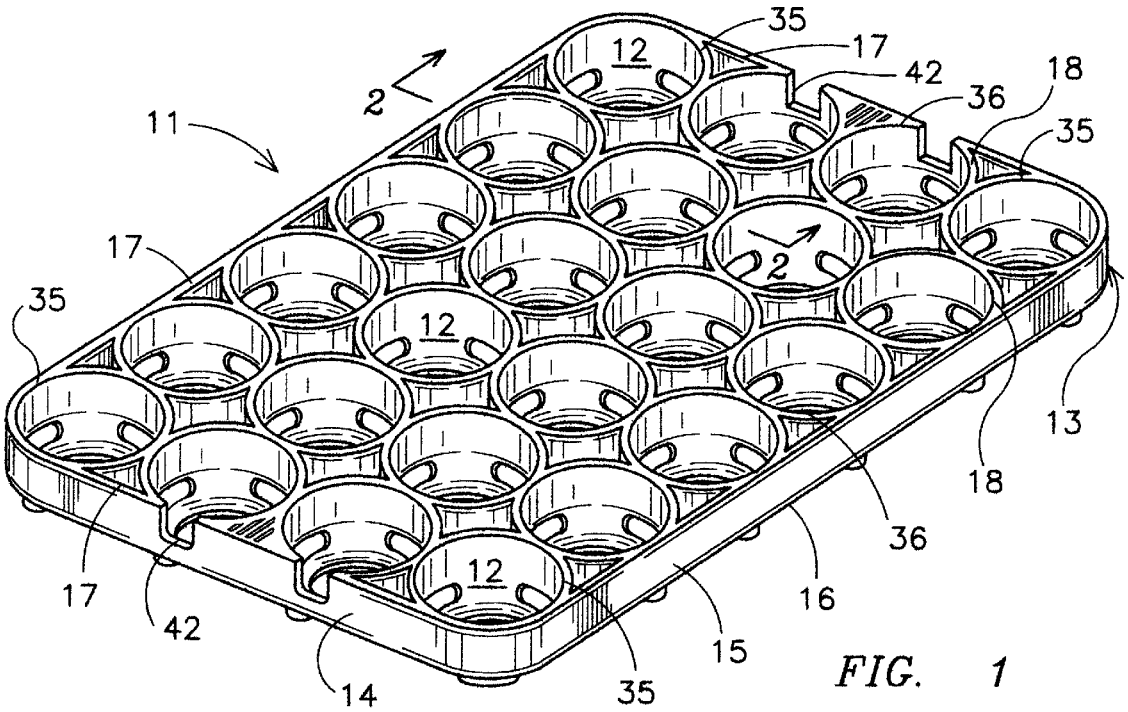
FIG. 1 is a perspective view of a beverage can tray.

The present invention is for a beverage can tray system and beverage can trays for storing and displaying cans. The tray system includes a plurality of trays 11 one of which is shown in FIG. 1. Each tray 11 includes a plurality of cells 12 integrally secured to form a rigid structure. Each cell 12 holds an individual can and includes a bottom section 24 that engages an upwardly disposed rim 21 of a can 19.

Figure 2:
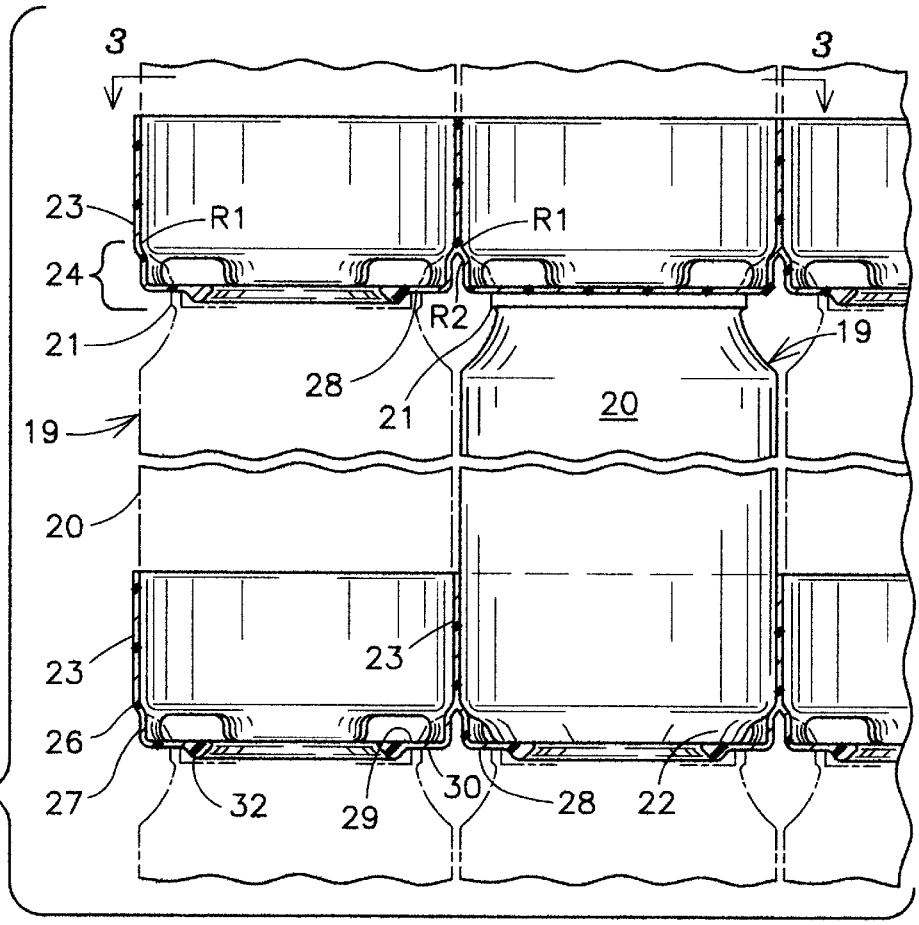
FIG. 2 is an exploded cross sectional view taken along line 2—2 in FIG. 6.

The embodiment in FIGS. 1 and 2 show the cells 12 secured within an outer panel 13. The entire tray is comprised of a durable plastic material in an injection molding so all the is elements of the tray 11 are integrally attached. The embodiment illustrated in the drawings includes a rectangular outer panel 13; however, invention is not limited to the specific rectangular shaped, but may include any variety of shapes. The cells 12 may be arranged in four rows of six cells to hold an entire case of cans.

The outer panel 13 includes two opposing end panels 14 and two opposing side panels 15. The end panels 14 and side panels 15 are integrally attached to form a rectangular outer panel 13. The outer panel 13 has a bottom edge 16 that defines a horizontal plane below which the cells 12 depend. The outer panel 13 also has a top edge 17, and each cell 12 similarly has a top edge 18. The cells 12 are secured within the tray 11 so the top edge 18 of each cell 12 is flush with the top edge 18 of the tray 11.

As shown in FIGS. 1 and 2, a can 19 has a cylindrical sidewall 20. The can 18 includes an upwardly disposed top rim 21 and downwardly disposed bottom section 22 both of which are integral the can sidewall 20. The cells 12 have a vertically disposed cylindrical sidewall 23 that has an inside diameter slightly larger than the outside diameter of a beverage can sidewall 20. A bottom section 24, integral the cell wall 23, depends below the horizontal plane defined by the bottom edge 16 of the outer panel 13.

The shape of the bottom section 24 is clearly shown in FIGS. 2, 5 and 10–12. The bottom section 24 of the cell 12 includes an inclined wall 26 that extends downward, from the cell wall 23, toward a central axis of the cell 12. The inclined wall 26 is integral the cell wall 23 and forms an inside radius R1 of 0.2 inches. A collar 27 is integral the inclined wall 26 forming a radius R2 of 0.094 inches.

A horizontal section 28 forms an inner surface 29 and outer surface 30 of the bottom 24 of the cell 12. An opening 31 in the lip 28 is centrally aligned on the central axis of the cell 12. A protuberance 32 is integral the outer surface 30 of the bottom section 24 of the cell 12. The protuberance 32 is preferably ring shaped, or circular, to mate with the upwardly disposed rim 21 of a can 19 in a lower tray to lock an upper tray on the lower can-filled tray. Consequently the diameter of the protuberance 32 is less than the inside diameter of the rim 21 of the can 19.

In a preferred embodiment the diameter of the protuberance 32 on the cell 12 in each of the four corners is of the tray 11 is slightly less than the other cells 12 in the tray 11. For example the protuberance 32 on the corner cells may be about 1.75 inches while the other cells' protuberance is 2.00 inches in diameter. As will be explained below this dimensioning of the protuberances allows for more flexible alignment for stacking can-filled trays.

Figure 3:
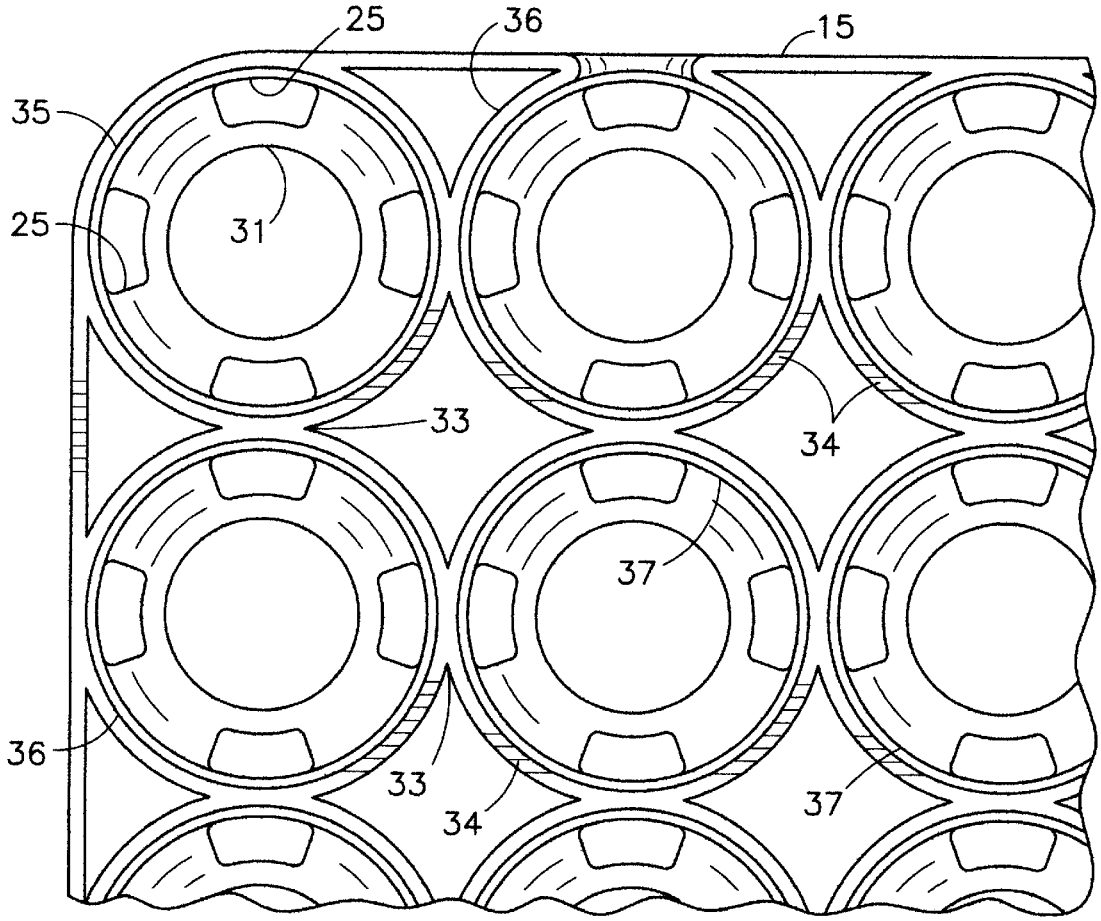
FIG. 3 is an exploded top view of the beverage can tray.
Figure 4:
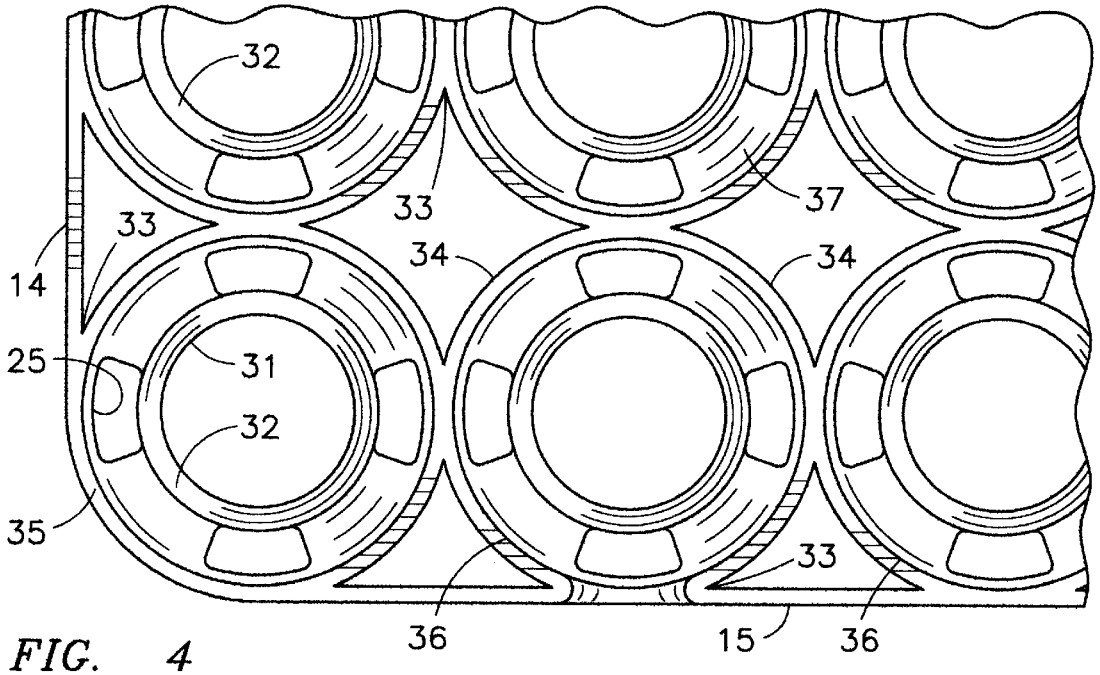
FIG. 4 is an exploded bottom view of the beverage can tray.

As shown in FIGS. 3 and 4, in addition to the central opening 30, there are a plurality of annularly spaced tab slots 25 formed in the inclined wall and collar in the bottom Section 24. Beverage cans are often packaged in six-pack units which are secured by a plastic ring commonly referred as Hi-Cone rings. These plastic rings have tabs that protrude upward. When can-filled trays are stacked, the tabs may become entangled in the bottom of the can tray; the tab slots 25 are positioned on the bottom section at points for receiving the tabs on the plastic rings.

Figure 11:
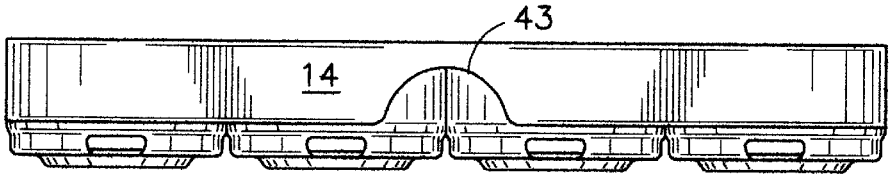
FIG. 11 is an end elevational view of the can tray.
Figure 10:
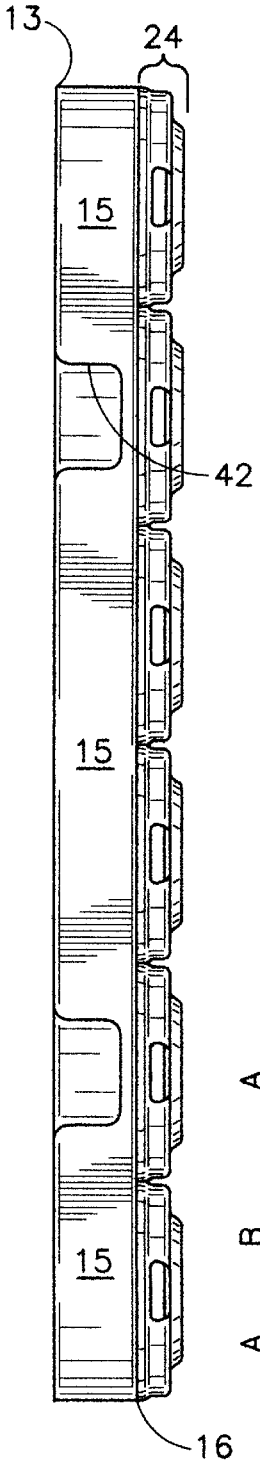
FIG. 10 is a side elevational view of the can tray.
Figure 12:
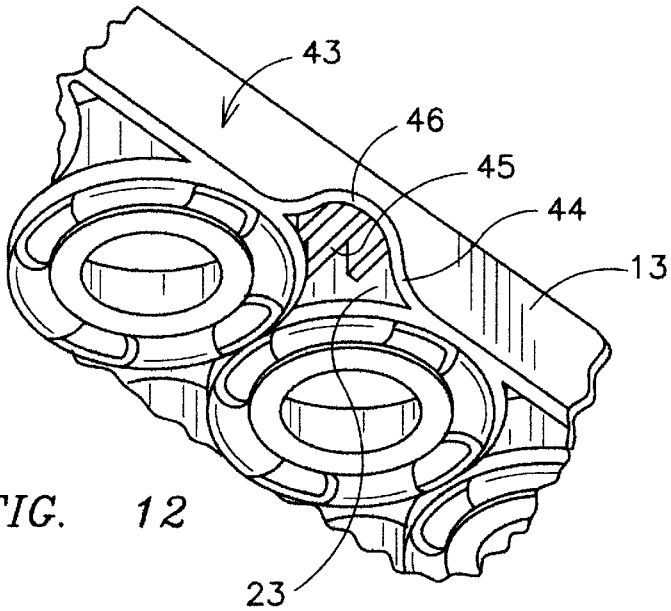
FIG. 12 is a bottom perspective of handle on a can tray.
Figure 13:
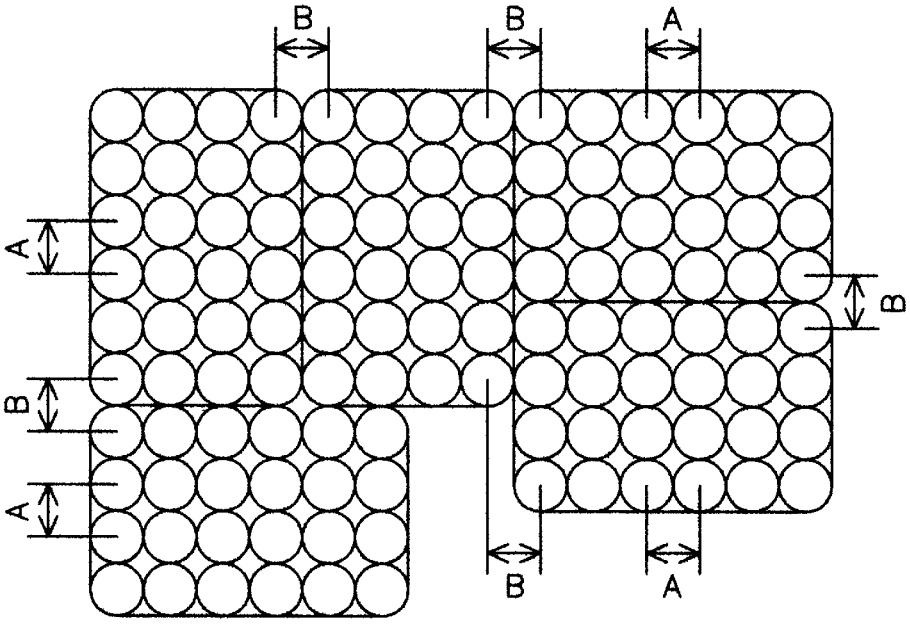
FIG. 13 is a top view of trays aligned side-side to represent a first centerline distance and a second centerline distance.

With respect to FIGS. 1, 10 and 11, gaps 42 are formed along the outer panel 13 either on the end panel or side panel adjacent cells 12. These gaps 42 expose a label or UPC code of a can 19. The tray 11 also includes a handle 43 integrally formed in the outer panel 13. The handle 43 includes a pocket 44 formed in the outer panel 13 and support member 45 extending intermediate the panel 13 and cells. The support member 45 illustrated in FIG. 12 includes a plurality of projections 46 integral the outer panel 13 and the cell walls 23.

As shown in FIG. 1, 3 and 4, the cells include the cells 35 in each of the four corners of the tray 11, the cells 36 aligned along the end panel 14 and side panels 15 intermediate the corner cells 35 and the cells 37 interior the corner cells 35 and side cells 36. The interior cells 37 are integrally connected to adjacent cells 12 at four tangency areas of the cell wall 23. The corner cells 35 and side cells 36 are connected to cells on one or more points and also to the panel 13 on one or more points. The cell-to-cell and cell-to-panel attachment creates a common area 33 between two cells 12 or between a cell 12 and the panel 13, and a plurality of free sections 34 intermediate the common areas 33 form the cell wall 23. This integral attachment of all of the cells creates a series of rigid structures between the cells that firmly secure end cell to an adjacent cell. The total of the integral attachments similarly provide an overall rigid structure for the tray.

The cell wall 23 for all the interior cells 37 has a uniform thickness. The tangency area 35 at adjacent interior cells is the same thickness as the free sections 34 of the interior cells. The cell walls 23 for the corner cells 35 and side cells 36 do not have a uniform thickness. The outer panel 13 forms a portion of the side walls 23 for each of the corner cells 35 and side cells 36. The outer panel 13 is approximately half as thick as the cell walls 23.

Figure 5:
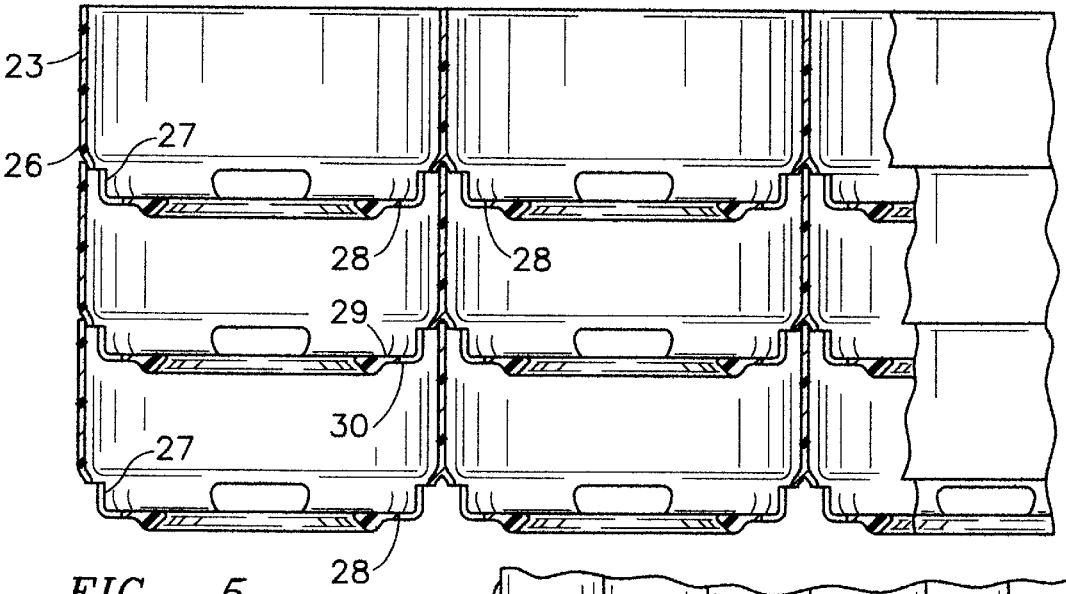
FIG. 5 is a sectional view of a plurality of stacked empty beverage can trays.
Figure 6:
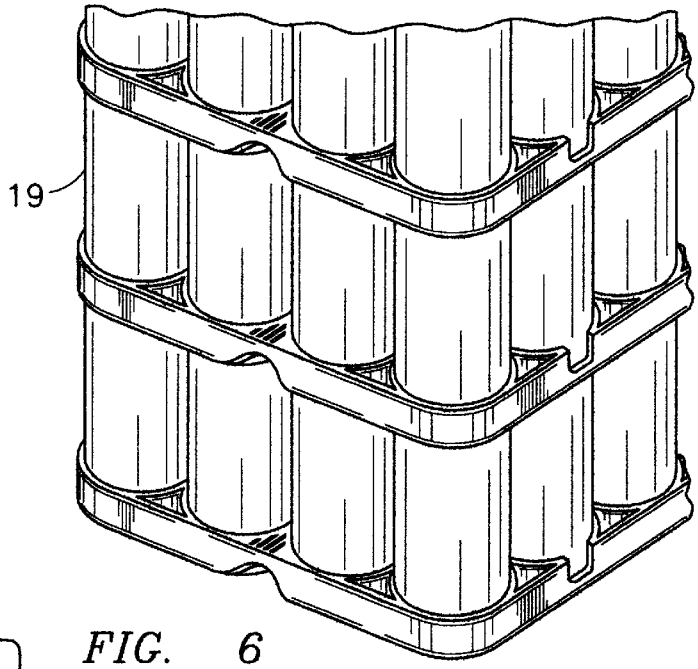
FIG. 6 is a perspective view of a plurality of stacked can-fill beverage can trays.

The interlocking nature of the beverage can trays and tray system illustrated in FIGS. 13, and 14A–14C. With respect to FIG. 13, there is illustrated a plurality of trays aligned side-by-side and end-to-end. In a single tray there exists a first centerline distance A between adjacent cells or cells sharing a common area 33 within a single tray. This centerline distance A between adjacent cells 12 within a single tray 11 is the same for all trays 11. Thus, when an upper tray is stacked atop a subjacent tray with the end panels and side panels aligned the bottom sections 24 of the cells 12 of the upper tray nest within the cells of the subjacent tray as illustrated in FIG. 5. Moreover, the protuberance will mate within the upper rim 21, as shown in FIGS. 2 and 6, securing an upper tray atop a lower can-filled tray.

As noted above the outer panel is approximately one half the thickness of the cell walls 23. When two trays are placed aside one another with the outer panels flush, there exists a centerline distance B between cells 12 along the outer panel in the first tray and cells 12 along the outer panel 13 of the second tray. As the outer panel 13 thickness is approximately one half the thickness of the cell walls 23, when two trays are placed aside one another the thickness of the two adjacent outer panels 12 is approximately equal to the thickness of the cell walls 23. The second centerline distance B between cells of adjacent trays is therefore approximately equal to the centerline distance A between adjacent cells 12 in a single tray 11.

The tray 11 and tray system is adapted to accommodate six-pack beverage can units that are secured by a Hi-Cone plastic ring. The centerline distances A and B are calculated or approximated with reference to the can separation and dimensions of a six pack unit held in a Hi-Cone plastic ring. The inside diameter of a cell may be approximately 2.64. The thickness of each cell wall including the common areas 33 and the free sections 34 is approximately 0.05 inches and the outer panel thickness is about 0.025 inches. Therefore the centerline distances measured from the center of adjacent cells is about 2.69 inches.

Figure 14:
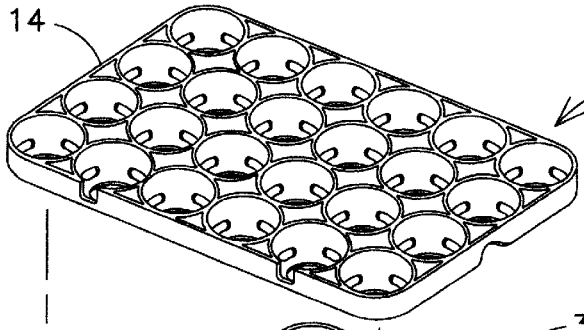
FIGS. 14–14A are a perspective view of can trays illustrating an alignment of stacked empty can trays.
Figure 14A:
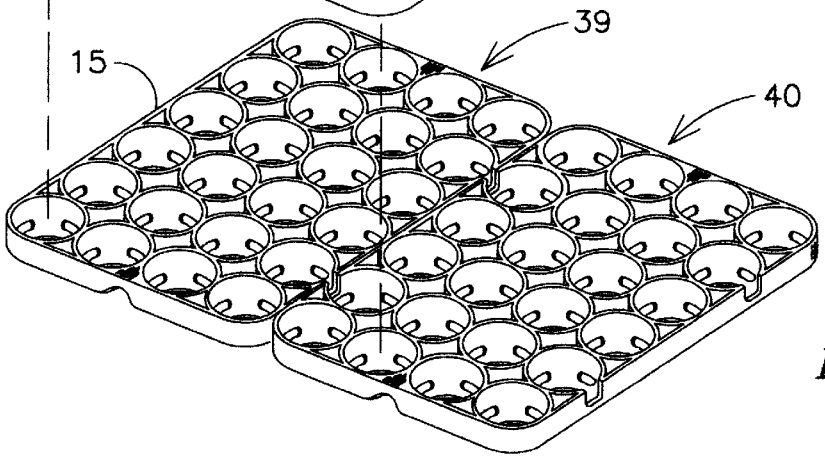
Figure 14B:
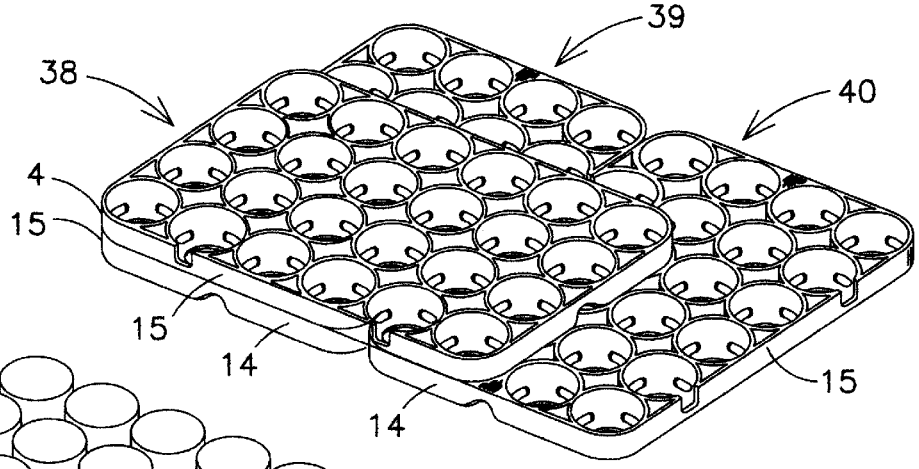
FIG. 14B is a perspective view of stacked empty beverage can trays.
Figure 14C:
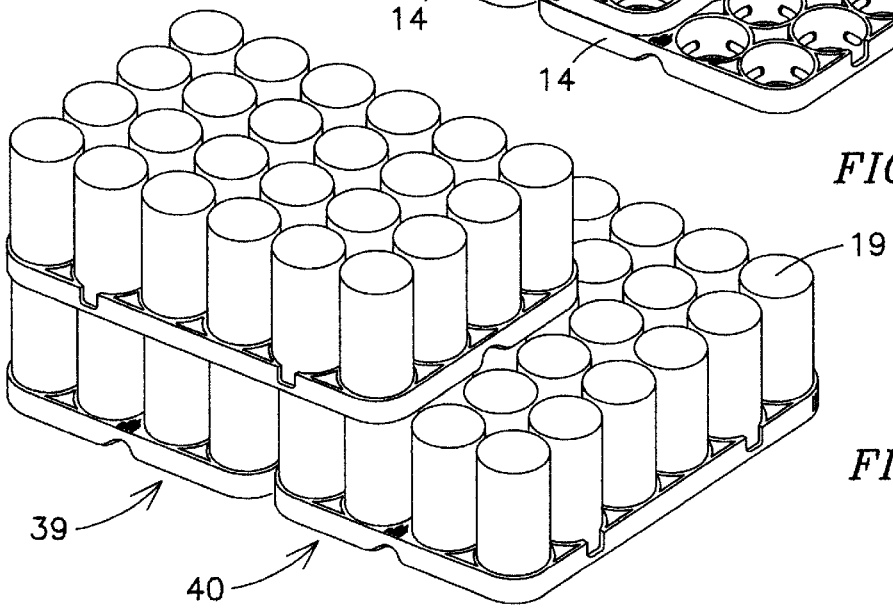
FIG. 14C is a perspective view of stacked can-filled trays.

Given these dimensions, the trays in this tray system will interlock when they are stacked atop one another as illustrated in FIG. 14A–14C. In these figures there is depicted an upper tray 41 stacked in perpendicular relationship to two subjacent trays 39 and 40 that are aligned side-by-side. The end panel 14 of the upper tray 41 is aligned with the side panel 15 of the subjacent tray 39 and the side panel 15 is aligned flush with the end panels 14 of both the subjacent trays 39 and 40. Each of the trays is a twenty-four can tray having four rows of six cells between the side panels or six rows of four cells between the end panels. Four rows of cells in the upper tray, and each of these cells fits within a corresponding cell in the subjacent tray 40.

Those cells in the upper tray are aligned with corresponding cells in the subjacent trays 39 and 40. When the trays are stacked, the tray 41 bridges the subjacent trays and secures the lower trays 39 and 40 together. In addition, the bottom section 24 of the cells 12 and the upper tray 41 nest within the cells of the subjacent trays 39 and 40 securing the upper tray with the subjacent trays 39 and 40. Similarly, when can-filled trays are stacked, the protuberance 32 depending from the bottom section 24 of the cell 12 will mate with the upper rim 21 of a can 19 interlocking the upper tray 41 with the cans 19 of the lower or subjacent trays. When stacking empty or can-filled trays, consecutive layers of trays preferably arranged in perpendicular relation in order to achieve this interlocking tray system.

Figure 7:
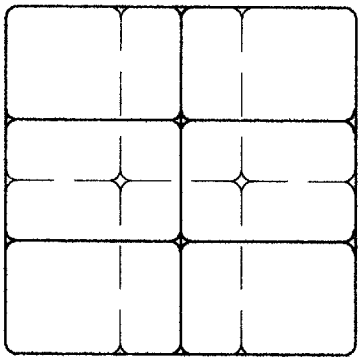
FIG. 7 is a top view representation of stacked trays.
Figure 8:
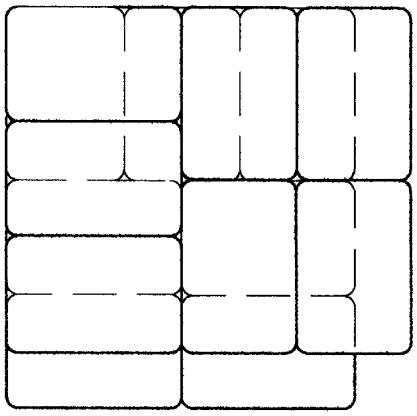
FIG. 8 is a top view representation of stacked trays.
Figure 9:
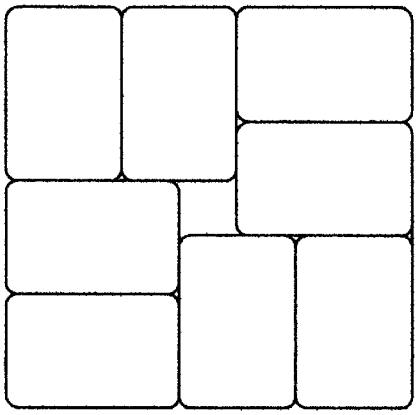
FIG. 9 is a top view representation of stacked trays.

The FIGS. 7 through 9 represent different oriented pillars used to stack trays and can-filled trays on pallets. The solid lines represent a top layer of trays, and the dashed lines represent a lower layer of trays. These drawings illustrate the perpendicular orientation of the consecutive layers to interlock and form a secure pillar of trays.

While we have disclosed the preferred embodiment of our invention, it is not intended that this description in any way limits the invention, but rather this invention should be limited only by a reasonable interpretation of the new recited claims.

Having thus described our invention what I claim as new and desire to secure by letters patent is:

1. A tray for storing and displaying cans, comprising:

a plurality of cells, each said cell having a vertically disposed cell wall and a bottom section, and each said cell integrally attached to an adjacent cell, the adjoined cell walls having a first thickness; and, means, attached to each said cell wall, for engaging an upwardly disposed rim of a can in a subjacent tray;

an outer panel encompassing a defined area and said plurality of cells secured within said defined area, the outer panel comprising a portion of the cell wall at points of tangency between the outer panel and the respective cell walls of cells aligned along the panel, wherein the thickness of the outer panel at the points of tangency being one half the first thickness, so that the centerline distance between adjacent cells of the tray equals the centerline distance between a cell aligned along the panel and a cell aligned along a panel of an adjacent identical tray.

2. A tray, as defined in claim 1, wherein said cell wall is a circular wall and the bottom section of each cell includes an inclined section integral said circular cell wall and extending toward a central axis of the cell, section and a horizontally disposed section, integral the inclined section.

3. A tray, as defined in claim 2, wherein said can engaging means includes a protuberance depending from the horizontally disposed section of the bottom section.

4. A tray, as defined in claim 1, wherein said cell wall is a circular wall and the bottom section of each cell includes a inclined section integral said circular cell wall and extending toward a central axis of the cell, section and a horizontally disposed section, integral the inclined section, said horizontally disposed section having an outer surface.

5. A tray, as defined in claim 4, wherein said tray further includes a plurality of tab slots formed in the bottom section of the cell and are annularly spaced apart.

6. A tray, as defined in claim 5, wherein said tray further includes an opening formed in the bottom section of the cell.

7. A tray, as defined in claim 6, wherein said tray further includes an outer panel encompassing a defined area and said plurality of cells secured within said defined area of the outer panel bottom section depending below a horizontal plane defined by a bottom edge of the outer panel.

8. A tray, as defined in claim 7, further including a handle means mounted to the outer panel.

9. A tray, as defined in claim 8, wherein said handle means includes a pocket formed in the outer panel a support member extending intermediate the outer panel and the cells.

10. A tray, as defined in claim 1, wherein said outer panel is a rectangular panel having opposing end panels and opposing side panels, with said end panels and side panels integrally attached to form the rectangular outer panel, and said plurality of cells are secured within the outer panel in a plurality of rows.

11. A tray, as defined in claim 1, wherein said cells include a first set of cells adjacent and integral each end panel and each side panel and a second set of cells intermediate the first set of cells and said tray includes a first centerline distance between adjacent cells within the tray and a second centerline distance between cells of the first set of cells and cells aligned along an outer panel of a second tray aside said tray with said second centerline distance approximately equal to the first centerline distance.

12. A tray, as defined in claim 11, wherein each cell of said second set of cells has a vertically disposed wall having a uniform thickness and each cell of said first set of cells has a vertically disposed wall section a portion of which is adjacent and integral the outer panel the portion of the cell walls of the first set of cells integral the outer panel having a thickness approximately one half the thickness of the cell wall of said second set of cells.

13. A tray, as defined in claim 12, wherein said cell wall is a circular wall and the bottom section of each cell includes a inclined section integral said circular cell wall and extending toward a central axis of the cell, section and a horizontally disposed section integral the inclined section.

14. A tray, as defined in claim 13, wherein said tray further includes means, attached to said outer surface of the horizontally disposed section of the cell, for engaging an upwardly disposed rim of a can.

15. A tray, as defined in claim 14, wherein said tray further includes a plurality of tab slots formed in the bottom section of the cell and are annularly spaced apart.

16. A tray, as defined in claim 15, wherein said tray further includes an opening formed in the bottom section of the cell.

17. A tray, as defined in claim 16, further including a handle means mounted to the outer panel.

18. A tray, as defined in claim 17, wherein said handle means includes a pocket formed in the outer panel a support member extending intermediate the outer panel and the cells.

19. A tray system for storing and displaying cans, comprising:

a plurality of cans, each said can having a vertically disposed circular wall, and upwardly disposed rim and a bottom;

a plurality of trays, wherein each said tray includes a plurality of cells arranged in rows integrally secured together and each said cell having a vertically disposed cell wall and a bottom section for maintaining a single can, wherein adjoined cell walls have a fist thickness; and, means, attached to each said cell, for engaging the upwardly disposed rim of a can;

each tray further comprising an outer panel encompassing its plurality of cells, the outer panel comprising a portion of the cell wall at points of tangency between the outer panel and the respective cell walls of cells aligned along the panel, wherein the thickness of the outer panel at the points of tangency being one half the first thickness, so that the centerline distance between adjacent cells of the tray equals the centerline distance between a cell aligned along the panel and a cell aligned along a panel of an adjacent tray.

20. A tray system, as defined in claim 19, wherein each said tray includes an outer panel encompassing a defined area and said panel including opposing end panels and side panels, and said bottom section of each cell depending below a horizontal plane defined by a bottom edge of the outer panel.

21. A tray system, as defined in claim 20, wherein said plurality of cells includes a first set of cells adjacent and integral the end panels and side panels of the outer panel and a second set of trays intermediate the first set of cells with said first centerline distance between the adjacent cells in the first and second set of cells of the first tray and the second centerline distance between the cells of the first set of cells of the first and second trays.

22. A tray system, as defined in claim 21, wherein the cell walls of the second set of cells have a uniform thickness and the cell walls of the first set of cells have a portion integral the outer panel that is one half the thickness of the cell wall thickness in said second set of cells.

23. A tray system, as defined in claim 22, wherein said bottom of each cell includes an inclined section integral the circular cell wall extending toward a central axis of the cell and a horizontally disposed section integral the inclined section said horizontal section having an outer surface.

24. A tray system, as defined in claim 23, wherein said tray further including a protuberance integral the outer surface of the horizontal section of the cell.

25. A tray system, as defined in claim 24, wherein said protuberance includes a ring shaped protuberance integral said horizontally disposed section with said ring-shaped protuberance has a diameter smaller than the diameter of a top rim of a can.

26. A tray system, as defined in claim 25, wherein said bottom section has a first opening and a plurality apertures annularly spaced apart around the opening.

27. A tray system, as defined in claim 26, further including a handle means mounted to the outer panel.

28. A tray system, as defined in claim 27, wherein said handle means includes a pocket formed in the outer panel and a support member above the pocket extending from the outer panel to the cells.

29. The tray system of claim 19, further comprising a first layer of cans in trays and a second layer of cans in trays stacked on top of the first layer of cans in trays, wherein the outer panels of the trays of the second layer are not aligned directly above the outer panels of the trays of the first layer.

30. A tray for storing cans, the tray comprising:

an outer panel defining an area;

a plurality of cells within the area;

a first common wall between two adjacent cells;

a second common wall between the outer panel and a cell aligned along the outer panel;

wherein the thickness of the second common wall is approximately half the thickness of the first common wall.

31. The tray of claim 30, wherein each cell comprises a bottom portion, and further comprising a tab slot formed in the bottom portion of at least one of the plurality of cells.

* * * * *